US010526748B2

(12) United States Patent
Özçelik et al.

(10) Patent No.: US 10,526,748 B2
(45) Date of Patent: Jan. 7, 2020

(54) METHOD OF PROVIDING MOISTURE BY ATOMIZATION IN OZONATION OF TEXTILE PRODUCTS

(71) Applicant: JEANOLOGIA TEKNOLOJI A.S., Izmir (TR)

(72) Inventors: Merih Özçelik, Izmir (TR); Hüseyin Aydin, Izmir (TR)

(73) Assignee: JEANOLOGIA TEKNOLOJI A.S., Izmir (TR)

( * ) Notice: Subject to any disclaimer, the term of this patent is extended or adjusted under 35 U.S.C. 154(b) by 0 days.

(21) Appl. No.: 15/958,946

(22) Filed: Apr. 20, 2018

(65) Prior Publication Data

US 2019/0194864 A1 Jun. 27, 2019

(30) Foreign Application Priority Data

Dec. 27, 2017 (TR) ..... 2017/22157
Mar. 20, 2018 (TR) ..... 2018/03905

(51) Int. Cl.

| | |
|---|---|
| ***D06L 4/50*** | (2017.01) |
| ***D06L 4/18*** | (2017.01) |
| ***D06L 1/14*** | (2006.01) |
| *B05B 17/06* | (2006.01) |
| *D06B 11/00* | (2006.01) |

(52) U.S. Cl.
CPC ..... *D06L 4/50* (2017.01); *D06L 1/14* (2013.01); *D06L 4/18* (2017.01); *B05B 17/0615* (2013.01); *D06B 11/0096* (2013.01)

(58) Field of Classification Search
CPC ..... D06L 4/50; D06L 4/10; D06L 4/04; D06L 1/12; D06L 4/29; D06L 4/18; D06L 1/14; B05B 17/0615; D06B 13/00
See application file for complete search history.

(56) References Cited

U.S. PATENT DOCUMENTS

2017/0121902 A1* 5/2017 Youn ..... D06P 5/132

FOREIGN PATENT DOCUMENTS

| | | |
|---|---|---|
| EP | 0 554 648 B1 | 4/1998 |
| WO | 2014/113238 A2 | 7/2014 |

* cited by examiner

*Primary Examiner* — Eisa B Elhilo
(74) *Attorney, Agent, or Firm* — Oliff PLC

(57) ABSTRACT

Methods and devices for providing moisture in an ozonation process applied to textile products. Unlike other existing moistening methods the invention relates to process of moistening which is provided by means of spraying water by an ultrasonic atomizer and supplying into enclosed volume in micro droplets and production of super oxide radicals with $O_3$.

17 Claims, 5 Drawing Sheets

⊕ WATER H2O
⊖ OZONE O3
⊗ SUPER OXIDIZING RADICALS

METHOD OF PROVIDING MOISTURE BY ATOMIZATION IN OZONATION OF TEXTILE PRODUCTS

TECHNICAL FIELD

Aspects of this invention relate to providing moisture for ozonation processes applied to textile products, and of providing needed moisture by spray of micro water droplets with ultrasonic atomization or water nebulizer.

BACKGROUND

Instead of chemicals conventionally used in finishing processes in textile, selection of chemicals having lower environmental impacts and also optimization of processes is needed and studies have been carried out in this line.

Ozone gas is used in bleaching as well as bleacher and color bleacher in parts washing processes of garments made from denim in recent years as ozone gas is a very strong bleacher in addition to its bactericide and fungicide feature.

Being an oxidative agent and an active oxygen source, Ozone has become an alternative to potassium permanganate, hypochlorite and hydrogen peroxide in processes of bleaching cotton fabrics and products. Ozone has advantage over other bleaching chemicals in finishing processes due to its features of not releasing residuals, not damaging environment and being efficient even at low temperatures.

In textile processes where ozone is used, ozone generator can produce ozone from air, and ozone shows a strong oxidative feature and is efficient at low temperature, it may not require addition of auxiliary chemicals and may provide saving in heating costs just because it is highly efficient at cold temperatures.

Ozone gas is generally used in small scale of denim washing processes for removal of dye and cleaning pocket back staining for the purpose of used effect and creation of patterns in denim washing sector.

Successful color fading by ozone is subject to fulfillment of some conditions. Firstly, the textile should be wet so that ozone may react with the dyes of textile products. System is preferred to have a given level of moisture during process. In addition, ambient temperature is to be kept substantially constant for a repeatable finishing result in ozonation process.

The moisture required for ozonising textile products with current ozonation systems is provided by means of directly wetting the textile products and/or putting wet fabric parts other than textile products. However, wetting fabric completely in line with these methods causes swelling of yarns in the fabric. This effect enhances surface area of yarn on fabric surface and supports ozone diffusion while ozone movement capacity is restricted in deeper parts of the fabric. Therefore, penetration of ozone into fabric reduces and ozonation performance decreases.

The document numbered EP0554648B1 discloses decolorizing a textile material containing cellulosic material having warp yarn with use of ozone. Said garment is dyed with an ozone oxidizable dye, said garment is wetted and then said garment is contacted in a vapour phase with a mixture of steam and ozone at high temperatures for a selected period of time. Here steam represents inert gases. Upon contacting steam, ozone oxidizes said dye and the oxidation with the ozone is terminated prior to any substantial oxidation of the warp yarn of the cellulosic material. Moisture textile material needing for ozonizing under this patent certificate is provided by means of heating the textile material.

PCT application numbered WO2014113238 discloses use of a dry ozonising process to decolorize a dyed denim fabric. With use of ozone, the application aims to eliminate disadvantages caused by stone washing method and use of bleaching chemicals. General and/or local decolorizing is provided in denim fabrics by means of applying three different methods containing use of ozone. In the first method, denim fabric is wetted, excess amount of water is removed and the fabric is subjected to ozone for decolorizing. In the second method, water is sprayed on to the area of denim desired to be decolorized and the fabric is exposed to ozone. In the third method, denim textile product and wet cotton fabric craps are put into a drum together and all drum content is exposed to ozone. Said three methods can be applied separately as well as in a combination. In the application, the moisture needed for ozonizing is provided by wetting the main fabric and/or putting wetted cotton scraps together with main fabric into the drum. In this application, for decolorizing regionally on the fabric, it is sprayed onto desired area.

SUMMARY

In one aspect, this disclosure can provide controlled moisture in the volume where ozonizing process is conducted for ozonation process in textile.

In another aspect, this disclosure describes methods and systems for providing moisture for the ozonation process as water in micro droplets form into the enclosed volume by means of ultrasonic atomizer or water nebulizer.

In another aspect, this disclosure describes methods and systems for performing ozonation process by use of less water through giving water to fabrics in micro droplets and infusing the atmosphere of the volume in which the textile is treated with the microdroplets.

In another aspect, this disclosure describes methods and systems that can prevent or reduce swelling and tightening of fabric threads such as fiber yarns during ozonation process by use of less amount of water. This enables ozone to pass through the fabric surface and penetrate farther into the fabric, as compared, for example, to methods in which the fabric is only wetted directly.

In another aspect, the methods and systems described herein form super oxide radicals by means of reaction of water micro droplets and $O_3$, and thus generate molecules having efficiency higher than $O_3$ effectiveness. Thus ozonation efficiency is enhanced by means of producing super oxide radicals which are more reactive than ozone.

BRIEF DESCRIPTION OF THE DRAWINGS

In order to achieve the purpose(s) of the invention, the interaction with the dry fibres, of super oxide radicals generated as a result of reaction of ozone with ultrasonic atomized and micro water droplets providing moisture to ozonation system is shown in the figures attached and in the figures.

DETAILED DESCRIPTION

In accordance with this disclosure, water can be atomized or nebulized and provided in an atmosphere with generated ozone for treating textiles and fabrics.

Ultrasonic atomization devices having ultrasonic atomizer terminals can be used for this purpose. The difference of ultrasonic atomizer terminals from other spray terminals is that they can perform spraying in fine grains of fog at low speed. Instead of using pressure, vibrational forces are used to provide it.

Figure 5:
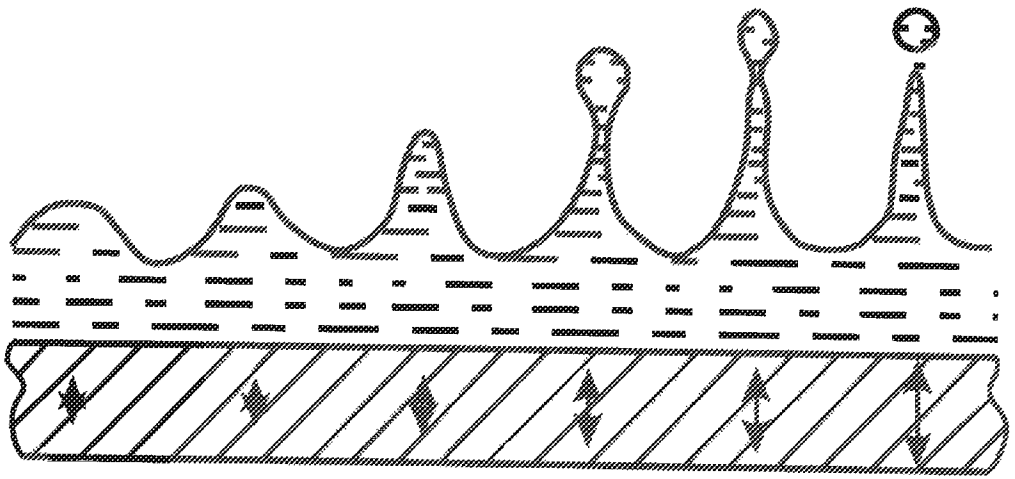
FIG. 5 is a schematic diagram illustrating atomization of a fluid.

The fluid is sprayed in fine fog form by use of high frequency of sound vibrations. Piezoelectric converters converts the electric input into mechanical energy in form of vibrations and this creates capillary waves in fluid film when sent to atomizing terminal. When vibration magnitude is increased, that capillary wave magnitude also reaches a certain critical high level. Waves become so high at this point that they cannot support their own structure and fine droplets start to fall from end of each wave in a manner to result in atomization, as illustrated in FIG. 5.

Droplets generated by ultrasonic atomization have relatively low size dispersion. Average droplet size varies from 10 nanometres-100 micrometer subject to frequency of end of atomization where worked. The significant factors affecting size of the generated droplets are the viscosity of vibration, surface voltage and fluid viscosity. Frequencies generally vary between 20 kHz-2.5 MHz. This frequency range is outside the range hearable by humans. In addition, high frequencies generate the lowest droplet size.

In addition to an atomizer, a nebulizer can be used to create a mist with fine water droplets.

Much more active super-oxidizing radicals generate upon reaction of water with $O_3$ under suitable conditions while water droplets still float in the air in addition to $O_3$ oxidizing radicals reacting with wet fabric by this-method. Such suitable conditions are the proper temperature and humidity conditions specified under patent application numbered TR2017/22157, which is incorporated by reference herein. Oxidizing radicals generated in this way are not of very stable structure as chemicals. When they hit any oxidizable agent or when suitable conditions disappear, they may immediately deform or degrade and lose their effects.

Some of the generated super-oxidizing radicals are as follows.

$$H_2O+O_3 \rightarrow H_2O_2+O_2$$

(Water H—O—H)+(Ozone O=O+—O$^-$)→(Hydrogen peroxide HO—OH)+(Oxygen O=O)

$$H_2O+O_3 \rightarrow H_2O_4$$

(Water H—O—H)+(Ozone O=O+—O$^-$)→(Tetraoxident HO—O—O—OH)

For instance, such super oxidizing radicals can be generated by adding $O_3$ into water or wetting the fabric but it may easily deteriorate because of intensive hydrostatic and hydrodynamic structure of water or fabric fiber consisting of other oxidizable chemicals.

According to previously used wet fabric and $O_3$ reaction methods, too strong oxidization reactions occur because of superoxidising radicals hitting the fabric surface. In addition, penetration (effect onto deeper part of yarn) of the superoxidizing radicals into dry fabric in micro water droplets (yams forming fabric) is much more than the penetration $O_3$ into wet fabric fiber.

Figure 2A:
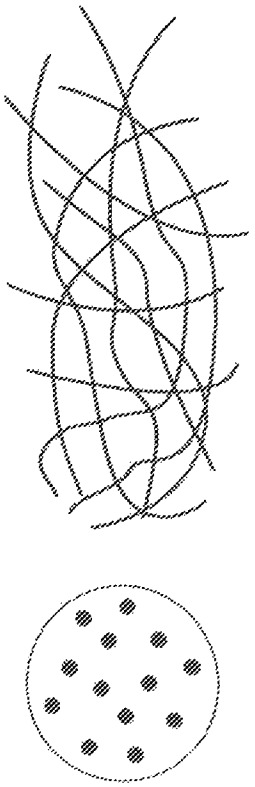
FIG. 2A Related Art
FIGS. 2A-2C is an illustrative view explaining interaction of wetted fibre with ozone in the related art.
Figure 2B:
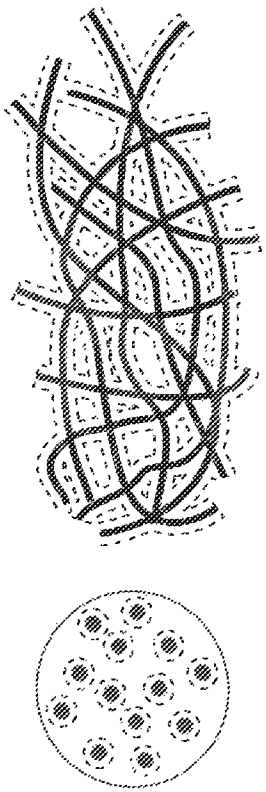
FIG. 2B Related Art
Figure 2C:
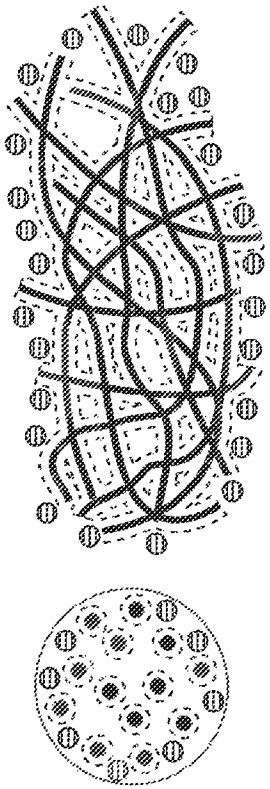
FIG. 2C Related Art
Figure 3A:
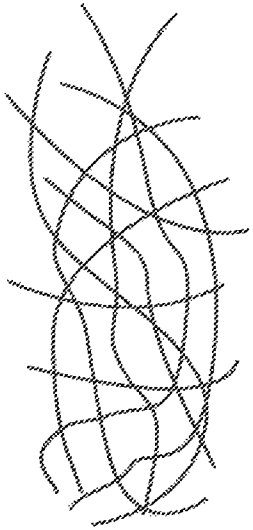
FIGS. 3A and 3B show interaction of micro water droplets comprising ozone and super oxide radicals with fiber under the present invention.
Figure 3B:
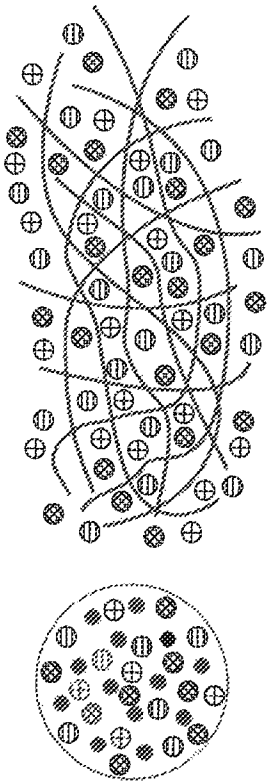

FIGS. 2A-2C schematically illustrate the interaction of wetted fibre with ozone in the related art. Here FIG. 2A represents dry fibre while FIG. 2B represents wetted fibre. FIG. 2C shows that ozone gas penetrates onto outer surface of fibre but could not penetrate deep in the fibre. Because in case of too wet fabric, water molecules filled in the fibre cause swelling, and lead in closure of porosities between yarns forming fibre, and prevents penetration of $O_3$ to fiber depths. In contrast, FIGS. 3A and 3B show that interaction of micro water droplets comprising ozone and super oxide radicals with fiber under embodiments the present invention. Here FIG. 3A represents dry fibre. FIG. 3B shows that water droplets loaded with ozone and super oxide radicals pass through porosities of dry fibre and can penetrate up to deep points of the fibre. In short, the formed super hot oxidizing radicals pass through air spaces without any barriers and reach interior fiber depths and the fiber reaches oxidizing paint/dye on the fiber surface and enables obtaining desired results.

Figure 1:
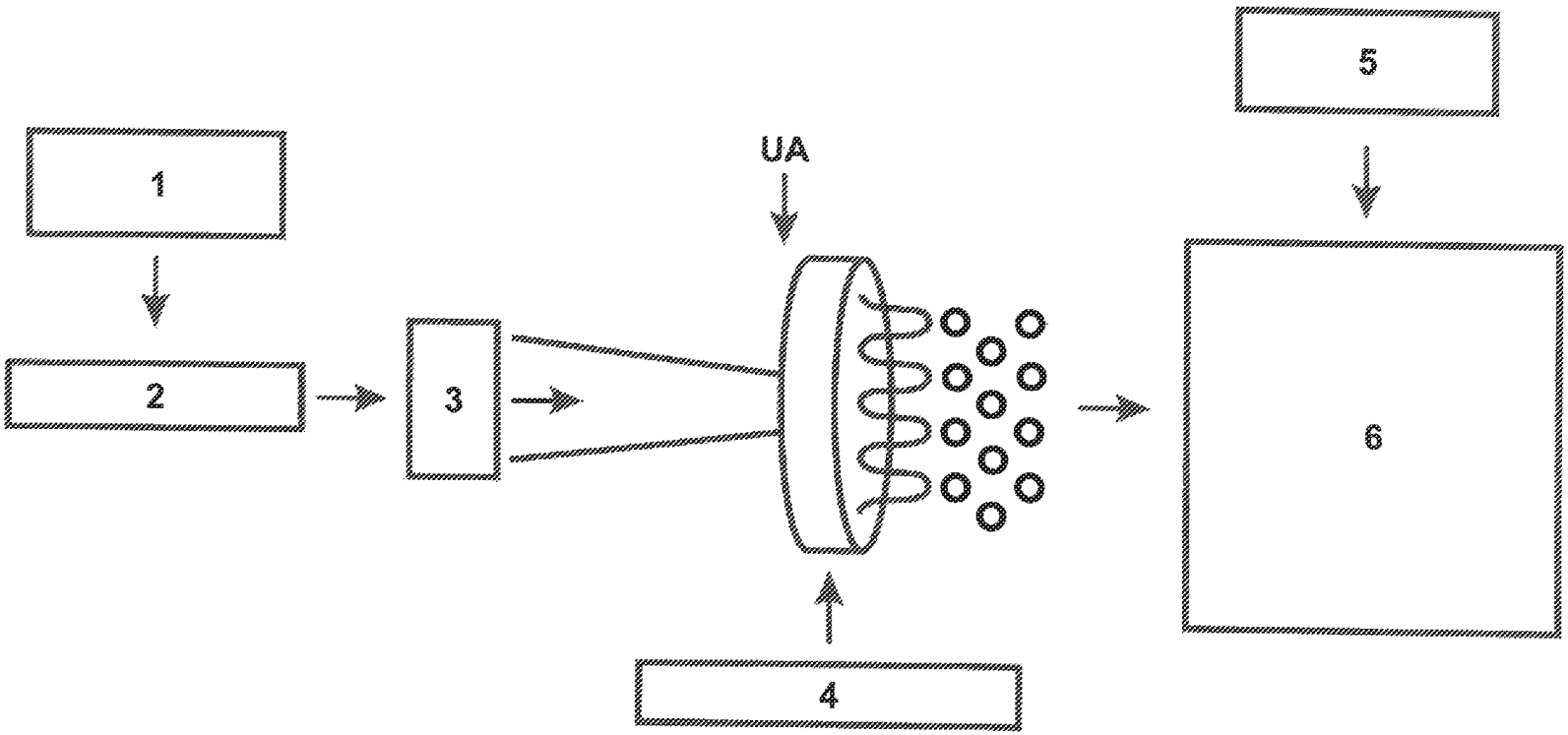
FIG. 1 is an illustrative view of ultrasonic atomiser used in ozonizing system.

As shown in the FIG. 1 embodiment, the ultrasonic atomizer (UA) used to provide moisture in ozonation process in its the most basic form is connected to

- a water/water solution source (1),
- an enclosed volume (5) to which an ozone source (6) is connected and wherein ozonation is conducted, and
- an ultrasonic generator (4).

In this embodiment, the ozonation process of fabric occurs in the enclosed volume (5) machine, and moisture is provided with an ultrasonic atomized (UA). One embodiment of the enclosed volume machine is described below in connection with FIG. 4.

In the related art, the fabric is oxidized by means of adding ozone into an enclosed volume (5) for bleaching colour of textile products. However, in order to ensure same darkness of the colour fading of the fabric, that is, to conduct ozonation process in a controlled manner, the moisture in the enclosed volume (5) can be maintained at required level. For achievement of this, water supply of micro droplet size is made to the container volume (5) of ozonation connected with an ultrasonic atomizer (UA). Water supply is provided by means of transmission of water to ultrasonic atomizer (UA) through liquid transmission system and supply of it to the enclosed volume (5) in micro droplets by spraying from ultrasonic atomizer. In addition, water (3) can be transferred separately as well as together with needed chemicals in the water. Subject to the rate of moisture required to be provided in ambience, the system can be persistently monitored and water of the needed quantity can be supplied to the system in micro droplets by means of the atomizer. As a result, upon bringing the supplied water (3) in micro droplets form, water and $O_3$ go into reaction and form super oxide radicals. Super oxide radicals which are much more reactive when compared to ozone enhance ozonation efficiency.

Steps of moistening for ozonation process are preferably conducted as follows:

- Ozone is generated or provided by ozone source (6) and is fed into the enclosed volume (5) where ozonizing process is conducted.
- Simultaneously with ozone and whenever needed, liquid is transmitted to the transmission system from a water source (1) to provide moisture.
- Water (3) can be given alone but it can also be given in a water solution (3) together with desired chemicals.

Water/water solution (3) is transmitted to ultrasonic atomizer (UA) in a desired flow rate subject to type of water transmission system (2).

Water/water solution (3) reaching end of atomizer end of the ultrasonic atomizer (UA) is converted into micro droplets of desired size subject to frequency quantity, by high frequency water vibration provided to atomizer end.

Produced micro droplets are given to enclosed system (5) by means of air flow.

Micro droplets react with ozone in the enclosed volume (5) and produce super oxide radicals.

Super oxide radicals and ozone formed therefore oxidize the fabric and provide colour fading of the fabric.

Figure 4:
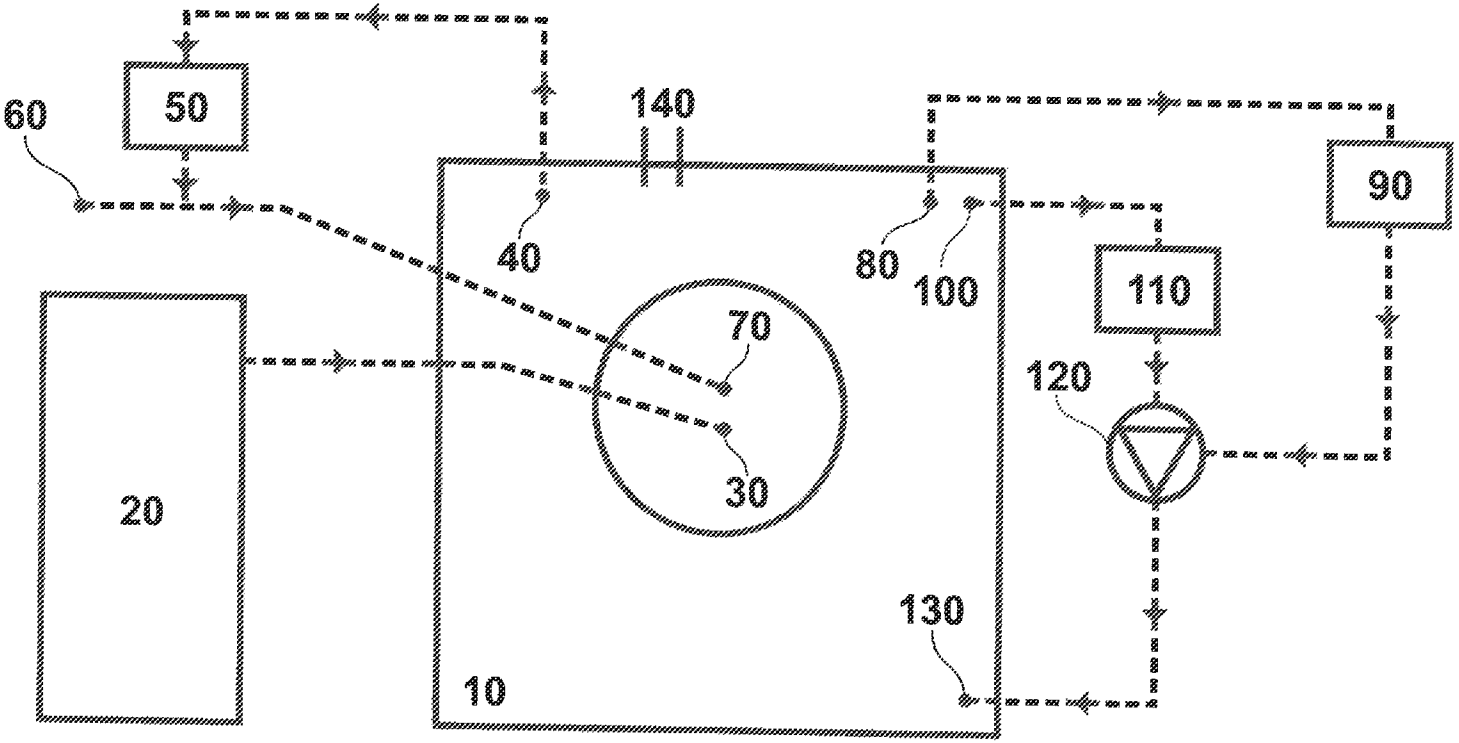
FIG. 4 is a schematic diagram of an ozonation system.

FIG. 4 illustrates another embodiment of an ozonation system for fabrics. The drum (enclosed volume) (10) used for ozonation process in its most basic form consists of an ozone generator (20) where ozone is generated and which is connected to drum for supply of the generated ozone to the drum, An ozone input point (30) on the drum for intake of ozone supplied from the ozone generator, A moisture sensor (40) located in the drum for measurement of the moisture inside the drum, a moisture measurement control system (50) having connection with moisture sensor and water source (60) and located outside the drum for regular control of moisture and providing water supply to the drum from the water source (60) when the moisture falls under the desired level, a water source (60) connected to the drum and the moisture measurement control system (50) for supply of water in order to keep the moisture in the drum at desired level, a moistening input (70) located near an ozone input point (30) on the drum and for intake of water supplied to the drum, A temperature sensor (80) located in the drum for measurement of the temperature inside the drum, a temperature measurement control system (90) having connection with temperature sensor and air fan (120) and located outside the drum, and providing air supply at convenient temperature to the drum from air fan (120) when the temperature falls under desired level/goes above the desired level for regular control of temperature, an absorption point (100) located on the drum for absorption of air or air/ozone mixture inside the drum and transfer into heat exchanger (110) and connected to heat exchanger (110) in order to bring the temperature inside the drum to desired level, a heat exchanger (110) connected to the absorption point (100) and the air fan (120) and wherein the temperature of air or air/ozone mixture from the drum is brought to the desired level by means of heating or cooling, an air fan (120) connected to the temperature measurement control system (90), a heat exchanger (110) and a feedback point (130) located on the drum, and pushing and directing into the drum the air and/or air/ozone mixture brought to desired temperature at the heat exchanger (110) upon a command received from temperature measurement control system (90), a feedback point (130) for intake of air or air/ozone mixture of the desired temperature supplied from the air fan (120) on the drum, a discharge (140) for removal of ozone converted into oxygen after use.

Aspects of the present invention provides conduct of process of ozonizing fabric inside the enclosed volume machine (10) at fixed ambient moisture and temperature. In any case, the moisture and temperature value inside the machine can be fixed by means of external intervention.

In the related art, the fabric is oxidized by means of adding ozone into an enclosed volume (10) for bleaching colour of textile products. However, in order to ensure same darkness of the colour fading of the fabric, that is, to conduct in a controlled manner, the moisture and temperature in the enclosed volume (10) must also be controllable. To provide it water addition and acclimatization is made to the machine by means of added mechanisms. The water addition can be made by means of flowing into the system through a pipe as well as by pulverizing through spraying or transferred into enclosed volume in micro dripping by means of water nebulizer or atomizer. In addition, water can be transferred separately as well as together with needed chemicals in the water. System is consistently monitored subject to moisture rate required to be provided in the ambience, water addition can be made when required. As a result, a controlled moistening is provided in a controlled enclosed volume (10) and moisture level is maintained.

Another significant parameter during ozonizing is the temperature value of the enclosed volume (10). To provide it again continuous acclimatizing is provided in the ambience. The air/ozone mixture absorbed from inside is passed through a heat exchanger (110) and cooled or heated and then re-supplied. The critical point here is to keep the inside of the machine (10) constant at preferred temperature without being influenced by ambient temperature.

A preferred embodiment of the invention, after the sent air is discharged, it is passed through a serpentine pipe type tunnel (heat exchanger (110) is heated or cooled and then supplied to the machine (10) again. Therefore, in this method the air coming from inside is brought to desired temperature level again and transferred into the machine (10).

The steps of the process are preferably conducted as follows:

Water is supplied to the enclosed volume (10) at the same time or separately and whenever needed to bring the moisture to the desired level and acclimatization is conducted to bring the temperature to desired value.

when the temperature in the enclosed volume reaches a predefined temperature, it is started to give ozone into the ambience during acclimatization. Acclimatization is continued during ozone process.

after treating the textile products in said enclosed volume for a given time period, ozone in the ambience is converted into oxygen and removed. Thus process can be completed without generation of any wastes harmful to environment.

REFERENCE NUMBERS

UA. Ultrasonic atomizer
1. Water/water solution source
2. Liquid transmission system
3. Water/water solution
4. Ultrasonic generator
5. Drum (Enclosed Volume)
6. Ozone source
10—Drum (Enclosed Volume)
20—Ozone Generator
30—Ozone Input Point
40—Moisture Sensor

50—Moisture Measurement Control System
60—Water Source
70—Moistening Input
80—Temperature Sensor
90—Temperature Measurement Control System
100—Absorption Point
110—Heat Exchanger
120—Air Fan
130—Feedback Point
140—Discharge

What is claimed is:

1. A process for treating textile or fabric comprising:

(i) providing ozone from an ozone supply to an enclosed space;

(ii) forming water droplets by atomizing or nebulizing water, and providing the water droplets to the enclosed space;

(iii) reacting water in the water droplets with the ozone; and (iv) then contacting the water droplets with the textile or fabric.

2. The process according to claim 1, wherein the textile or fabric is not wetted prior to being contacted with the water droplets.

3. The process according to claim 1, wherein the water droplets are formed by atomizing the water with an ultrasonic atomizer.

4. The process according to claim 1, wherein the step of reacting the water in the water droplets with the ozone generates super oxide radicals.

5. The process according to claim 1, wherein the water that forms the water droplets is either provided by itself or together with at least one chemical used to treat fibers.

6. The process according to claim 3, wherein the water is transferred to the ultrasonic atomizer by a liquid transmission system.

7. The process according to claim 6, wherein the liquid transmission system is selected from a group consisting of a gear or piston pump, a compressed chamber, a peristaltic pump, a membrane pump, a natural flowing supply, or combinations thereof.

8. The process according to claim 1, wherein a flow rate of water that is used to form the water droplets is in the range of from 0.1-1,000 liters/hour.

9. The process according to claim 1, wherein the water droplets are contacted with the textile or fabric in the enclosed space.

10. The process according to claim 3, wherein the ultrasonic atomizer is operated at a frequency that is in the range of from 20 KHz-2.5 MHz.

11. The process according to claim 1, wherein the water droplets have an average size that is in the range of from 10 nanometres to 100 micrometers.

12. The process according to claim 1, wherein the water droplets are formed and then transmitted to the enclosed space.

13. The process according to claim 1, wherein an amount of the water droplets contacting the textile or fabric is controlled so that, after the process, a treated textile or fabric product has a moisture content that is in a range of from 1 wt. % to 25 wt. %.

14. The process according to claim 1, wherein a moisture content of the textile or fabric is in the range of from 3 wt. % to 5 wt. % prior to being contacted with the water droplets.

15. The process according to claim 1, wherein the textile or fabric comprises denim.

16. The process according to claim 1, wherein the water in the water droplets are reacted with the ozone while the water droplets are moving in air in the enclosed space.

17. The process according to claim 1, wherein the enclosed space is a drum.

* * * * *